United States Patent [19]

Dutcher

[11] Patent Number: 4,784,315

[45] Date of Patent: Nov. 15, 1988

[54] TWO PIECE SLIDING CARTON

[75] Inventor: Daniel P. Dutcher, Coon Rapids, Minn.

[73] Assignee: Waldolf Corporation, St. Paul, Minn.

[21] Appl. No.: 170,067

[22] Filed: Mar. 14, 1988

Related U.S. Application Data

[63] Continuation of Ser. No. 107,242, Oct. 9, 1987, abandoned.

[51] Int. Cl.[4] ..... B65D 5/38

[52] U.S. Cl. ..... 229/9; 229/125.08; 229/23 BT; 229/125.29

[58] Field of Search ..... 229/9, 19, 16 A, 125.08, 229/125.26, 125.28, 125.29, 901, 164, 23 BT; 206/444, 45.15, 45.18, 602

[56] References Cited

U.S. PATENT DOCUMENTS

| | | | |
|---|---|---|---|
| 578,669 | 3/1987 | Watkins . | |
| 887,729 | 5/1908 | Kirmse . | |
| 1,684,385 | 9/1928 | Batkin . | |
| 2,358,802 | 9/1944 | Glover . | |
| 3,866,747 | 2/1975 | Scholz | 229/125.08 |
| 4,340,168 | 7/1982 | Webinger . | |
| 4,470,538 | 9/1984 | Heathcock et al. | 229/125.08 |
| 4,534,463 | 8/1985 | Bouchard | 229/9 |
| 4,634,001 | 1/1987 | Wakelin | 206/444 |
| 4,646,960 | 3/1987 | Challand . | |

*Primary Examiner*—Willis Little

*Attorney, Agent, or Firm*—Dorsey & Whitney

[57] ABSTRACT

A two-part sliding carton has a base part having generally the shape of a box with a rectangular cross-section open at the top. The base part has a bottom panel on which said base part normally rests and a rear panel with a generally horizontal hinge slit covered by a cover panel, one edge of which is affixed to the interior of the base part at a line below said hinge slit. The cover panel extends from below the hinge slit substantially to the upper edge of said rear panel to define a slide pocket between said hinge slit and said upper edge. The carton also has a cover part having generally the shape of a box with a rectangular cross-section slightly larger than the comparable cross-section of the base part, said box being open at the bottom. The cover part has a rear panel with a hinge panel joined at its bottom edge at a hinge fold line. The hinge panel is slidingly inserted through the hinge slit to lie between said rear panel and said cover panel in the slide pocket when the cover part is raised relative to the base part for opening. The hinge panel remains in said slide pocket when the carton is opened by rotating the two parts relative to each other around the hinge fold line until the cover part no longer covers the base part.

20 Claims, 7 Drawing Sheets

TWO PIECE SLIDING CARTON

This application is a continuation of application Ser. No. 107,242, filed Oct. 9, 1987, now abandoned.

BACKGROUND OF THE INVENTION

1. Field of the Invention

The present invention relates generally to rectangular box cartons that are made in two nested pieces and slide open. More particularly, the present invention relates to a rectangular box carton for computer diskettes or the like in which a base piece is nested in and connected to a cover piece. Connection is by a sliding hinge that permits the cover piece of the carton to slide and rotate for opening the carton while the two pieces forming the carton remain connected at the hinge.

2. Description of the Prior Art

Cartons for computer diskettes and other articles packaged in multiples are often made in rectangular box shapes. If items to be contained are flat, the carton can be given dimensions slightly larger than the rectangular size of the enclosed articles and given a suitable depth, so that a stack of several such items can be retained within the carton. While the sealing or closure method used for some cartons is such that they are damaged or not easily reclosed once they are opened, with other cartons a design effort is made to permit the carton to be easily opened and reclosed. This is because articles such as computer diskettes are often retained for several months or even years, and a protective storage and filing carton is useful. In addition, in many applications, the stored diskettes may be the subject of frequent use by the operator of a word processing machine or other computerized equipment. In this case, the operator requires an easily opened and closed filing container that can be placed at or near a work station and provides ready access to the diskettes At least one plastic container design (made in the United Kingdom under the trademark "SHADE", U.K. Pat. No. 8315041) is known that comprises two parts that slide to permit the container to be opened but remain connected and form an upright file or holder for diskettes. The mechanism for this container is somewhat intricate, as it involves tracks on opposite sides of one part of the container in which pins extending from the other part of the container run. While moldable in plastic, it could not be easily adapted for a container made of the most widely used packaging material: paperboard.

The most common form for a two-piece, nested paperboard diskette carton requires that the base and cover pieces slide to full separation in order to access the diskettes. Because one part of the carton (usually the cover) often includes a label identifying the contents of the carton, the separation of one carton part from the other provides the opportunity for a carton part with identifying information to be associated with the incorrect complementary part, thereby leading to mis-identification of the carton contents. A separated carton part may also be completely lost.

Accordingly, what is needed to improve the prior art is a paperboard carton design that easily slides open to permit access to carton contents but permits the two carton parts to remain connected after opening. In addition, it is desirable that the opened carton provide a stable filing and holding container for storing diskettes or other articles in use at a work station.

SUMMARY OF THE INVENTION

In the present invention, a two-part sliding carton has a base part having generally the shape of a box with a rectangular cross-section open at the top. The base part has a bottom panel on which said base part normally rests and a rear panel with a generally horizontal hinge slit covered by a cover panel, one edge of which is affixed to the interior of the base part at a line below said hinge slit. The cover panel extends from below the hinge slit substantially to the upper edge of said rear panel to define a slide pocket between said hinge slit and said upper edge. The carton also has a cover part having generally the shape of a box with a rectangular cross-section slightly larger than the comparable cross-section of the base part, said box being open at the bottom. The cover part has a rear panel with a hinge panel joined at its bottom edge at a hinge fold line. The hinge panel is slidingly inserted through the hinge slit to lie between said rear panel and said cover panel in the slide pocket when the cover part is raised relative to the base part for opening and remains in said slide pocket when the carton is opened by rotating the two parts relative to each other around the hinge fold line until the cover part no longer covers the base part. The invention also encompasses a two-piece blank from which the base part and cover part of the invention are formed.

It is an objective of the present invention to provide a two-piece, nested, rectangular box carton that slides open to permit access to its contents.

It is another objective of the invention to provide a two-piece, nested rectangular box carton in which the two pieces remain connected after the carton is opened, unless deliberately separated.

It is a further objective of the present invention to provide a computer diskette carton design that permits the fully opened carton to have a broader base than the carton unopened, to thereby provide a stable work station file for computer diskettes when the carton is in its open condition.

These and other objectives of the invention will become clearer in the following detailed discussion of the preferred embodiment of the invention, including the following drawings.

DESCRIPTION OF THE PREFERRED EMBODIMENT

Figure 10:
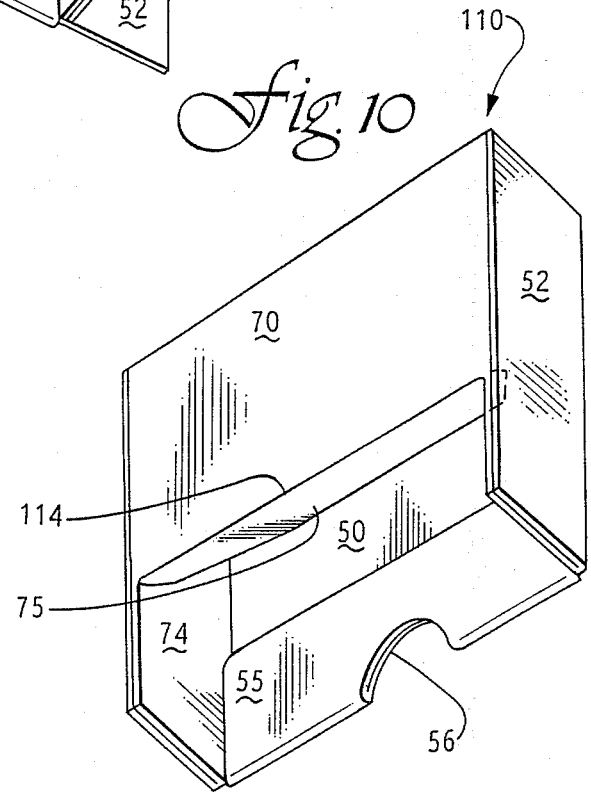
FIG. 10 is a perspective view of the completed cover part of the carton, showing the rear side with the hinge panel, the right side and a portion of the inside of the front side.
Figure 11:
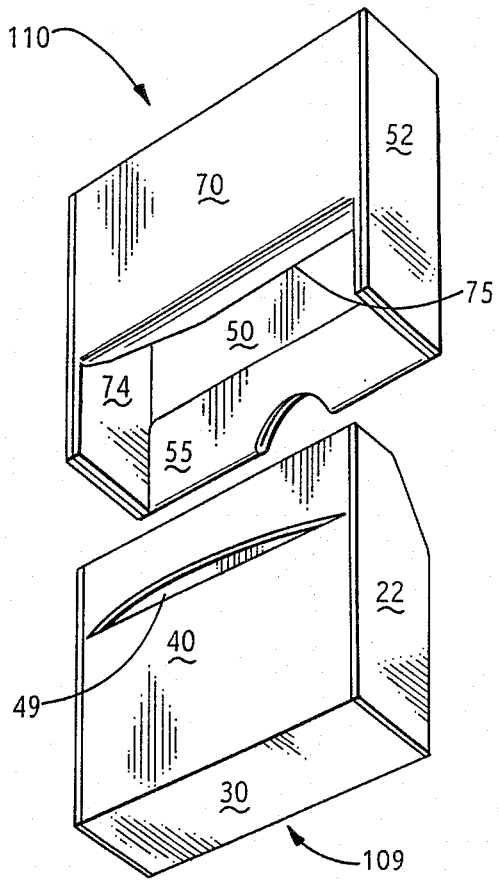
FIG. 11 is an exploded view in perspective, showing the orientation of base and cover parts of the carton before assembly.
Figure 17:
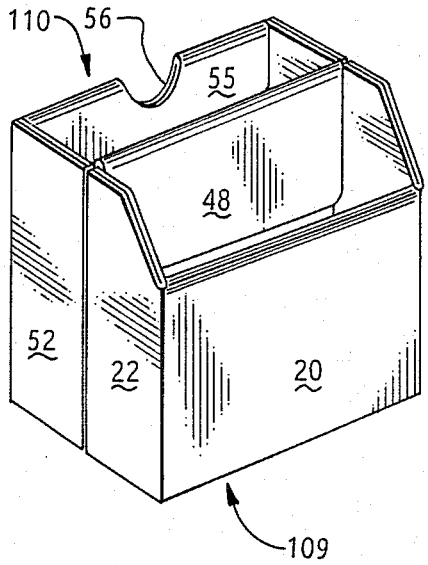
FIG. 17 is a perspective view of the opened carton.

As best seen in FIGS. 1–2, 6–7 and 11, the carton of the present invention is made from two separate flat blanks, a base blank 9 and a cover blank 10. These two blanks are separately assembled into a base part 109 (FIG. 5) and a cover part 110 (FIG. 10), then nested and joined together at a hinge panel 75 to form the two-part sliding carton of the present invention. In the preferred embodiment shown in the drawings, the base part 109 nests within the cover part 110 and the hinge panel 75 is part of the cover part 110, entering and riding in a slide pocket 49 in the base part 109. It will be clear, however, that the nesting and hinge location could be reversed.

Figure 1:
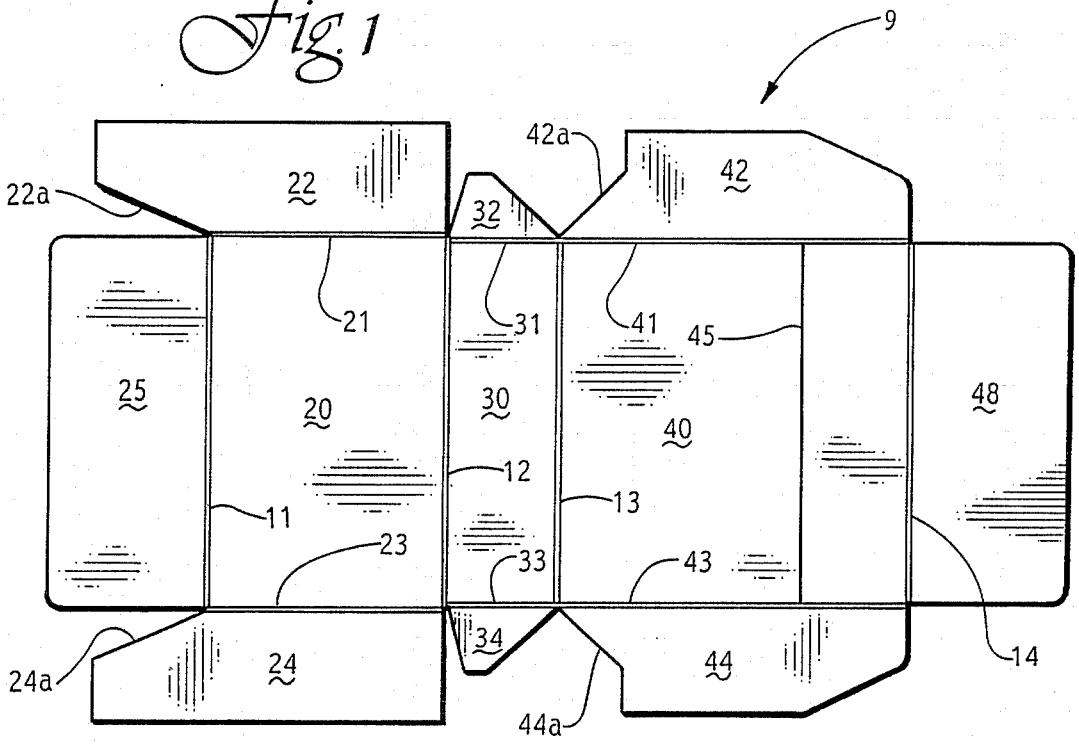
FIG. 1 is a top plan view of a flat blank for the base part of the invention.
Figure 2:
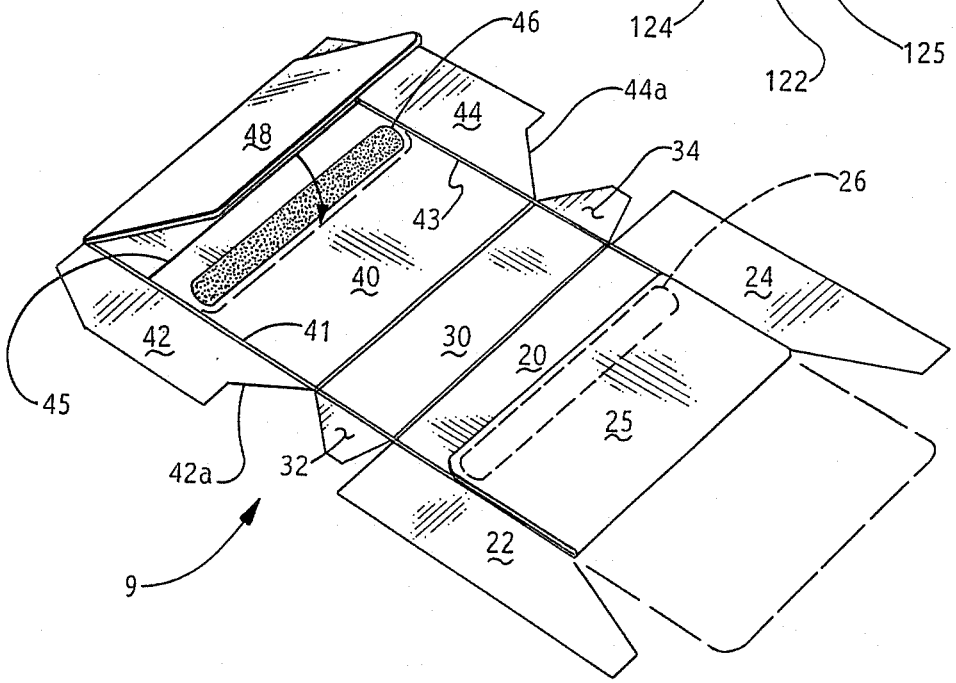
FIG. 2 is a perspective view of the base blank with some portions glued and folded and other portions in the process of being folded.

Turning first to FIGS. 1–2, the base blank 9 consists of a generally rectangular front panel 20 attached at a first major fold line 12 to a bottom panel 30. Opposite and parallel to the first major fold line 12 is an auxiliary fold line 11, at which a front reinforcing flap 25 is joined to the front panel 20. At opposing parallel side fold lines 21, 23 of the front panel 20, symmetrical, generally rectangular, right and left outer side wall panels 22, 24 are attached. Both outer side wall panels 22, 24 include one angular cut edge 22*a*, 24*a*, respectively, the function of which will be explained below.

The bottom panel 30 is also generally rectangular in shape. At opposing, parallel side fold lines 31, 33, left and right side base corner reinforcing flaps 32, 34, respectively, are attached to the bottom panel 30. At the edge of the bottom panel 30 opposing and parallel to the first major fold line 12 is a second major fold line 13, at which a rear panel 40 is attached to the bottom panel 30.

The rear panel 40 comprises a generally rectangular surface bounded by the second major fold line 13, with opposing, parallel side fold lines 41, 43 perpendicular thereto and by third major fold line 14, opposite and parallel to second major fold line 13. At the opposing side fold lines 41, 43 two inner side wall panels 42, 44 are connected. The wall panels 42, 44 are of irregular polygonal shape, with a broken angular cut edge 42*a*, 44*a*, respectively. Intermediate the second and third major fold lines 13, 14 and parallel to each of them but lying closer to fold line 14 (about one-third the distance from fold line 14 to fold line 13) is a hinge slit 45. In the preferred embodiment shown, it extends between the side fold lines 41, 43. A strip adjacent the hinge slit 45 and lying between the hinge slit 45 and the second major fold line 13 forms a glue area 46 (FIG. 2). As will be explained in greater detail later, to this glue area 46 is fastened the outer edge of a slide pocket cover panel 48. In base blank 9, the cover panel 48 is connected to the rear panel 40 at the third major fold line 14.

Figure 6:
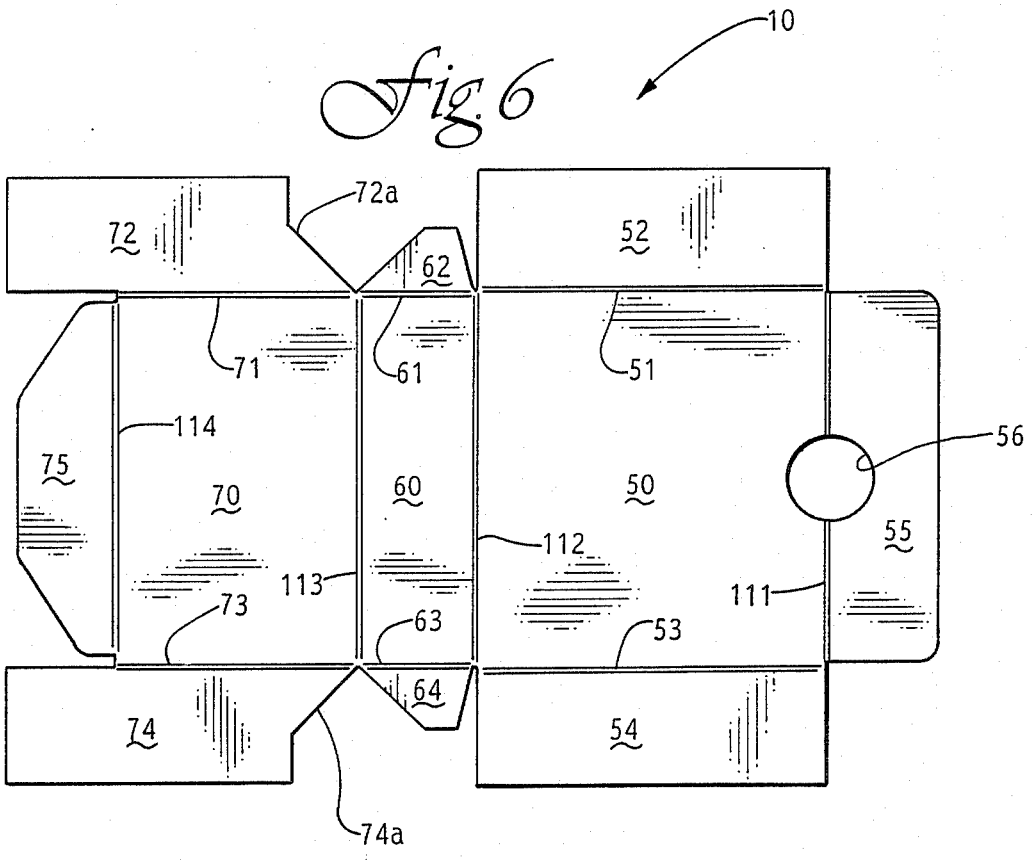
FIG. 6 is a top plan view of a flat blank for the cover part of invention.
Figure 7:
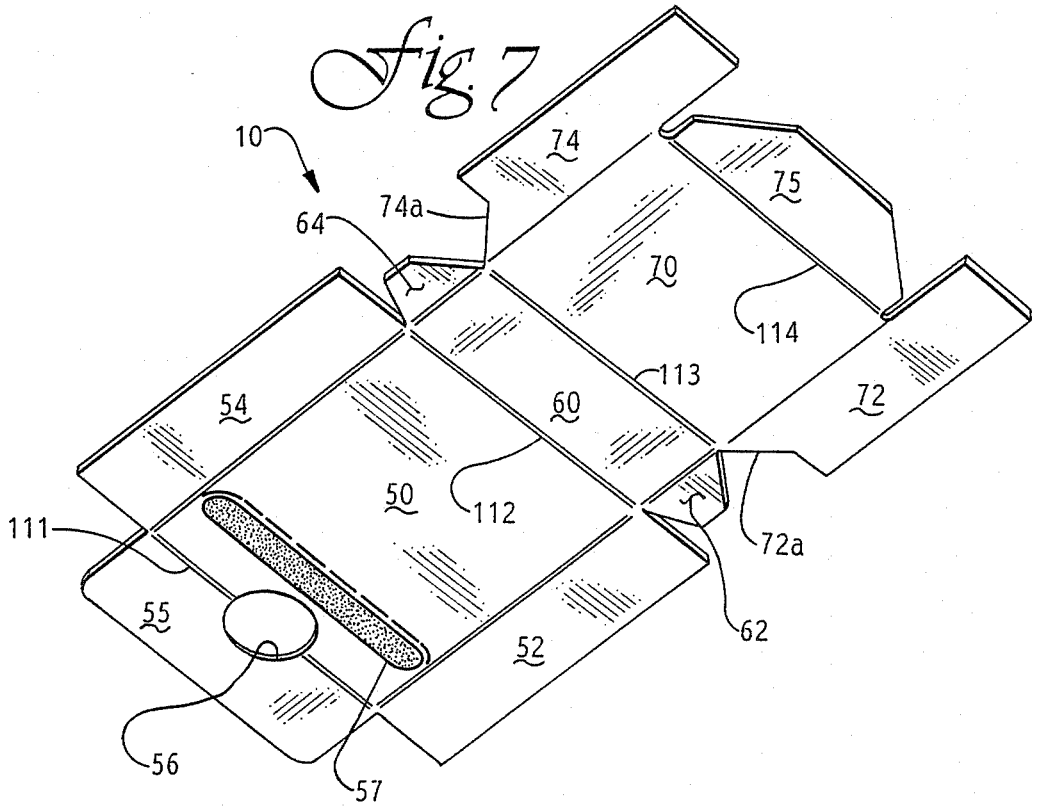
FIG. 7 is a perspective view of the cover blank showing the beginning of the glue and fold process.

As best seen in FIGS. 6–7, the cover blank 10 comprises a generally rectangular front panel 50 bounded by fourth major fold line 112 and, parallel thereto, auxiliary fold line 111, together with side fold lines 51, 53, being parallel to each other and perpendicular to each of the fourth major fold line 112 and auxiliary fold line 111. A pair of rectangular outer side wall panels 52, 54 is joined to the front panel 50 at the side fold lines 51, 53 respectively. A front reinforcing flap 55 is joined to the front panel 50 at auxiliary fold line 111. A circular grip cutout 56 straddles the auxiliary fold line 111.

Joined to the front panel 50 at the fourth major fold line 112 is a generally rectangular top panel 60. The top panel 60 is bounded by the fourth major fold line 112 and a fifth major fold line 113 parallel thereto, with side fold lines 61, 63 parallel to each other and perpendicular to the fourth and fifth major fold lines 112, 113, respectively, defining the remaining two edges. Two corner reinforcing flaps 62, 64 are connected to the top panel 60 at the side fold lines 61, 63, respectively.

Joined to the top panel 60 at the fifth major fold line 113 is a generally rectangular rear panel 70. The edges of the rear panel 70 are defined by the fifth major fold line 113 and the sixth major fold line 114 parallel thereto, together with side fold lines 71, 73 being parallel to each other and perpendicular to the fifth major fold line 113 and sixth major (or hinge) fold line 114. Attached to the rear panel 70 at the side fold lines 71, 73 are two inner side wall panels 72, 74, respectively. Each is roughly rectangular in shape with a broken angular cut 72*a*, 74*a* respectively, at one end, shaped to fit with the adjacent corner reinforcing flap 62, 64, respectively, associated with the top panel 60. Also attached to the rear panel 70 (at sixth major fold line 114) is a hinge panel 75 that is roughly trapezoidal in shape.

Figure 1A:
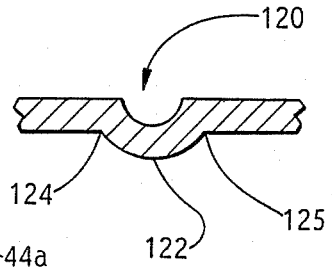
FIG. 1*a* is an enlarged fragmentary sectional detail of a typical fold line score for a blank used in the invention.
Figure 4:
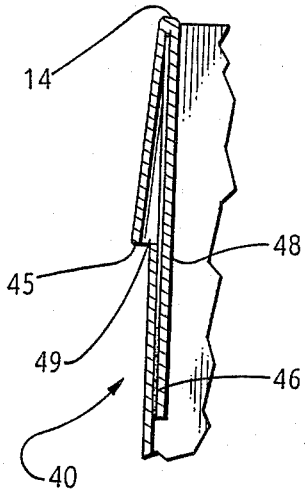
FIG. 4 is an enlarged fragmentary section taken along line 4—4 of FIG. 3.
Figure 5:
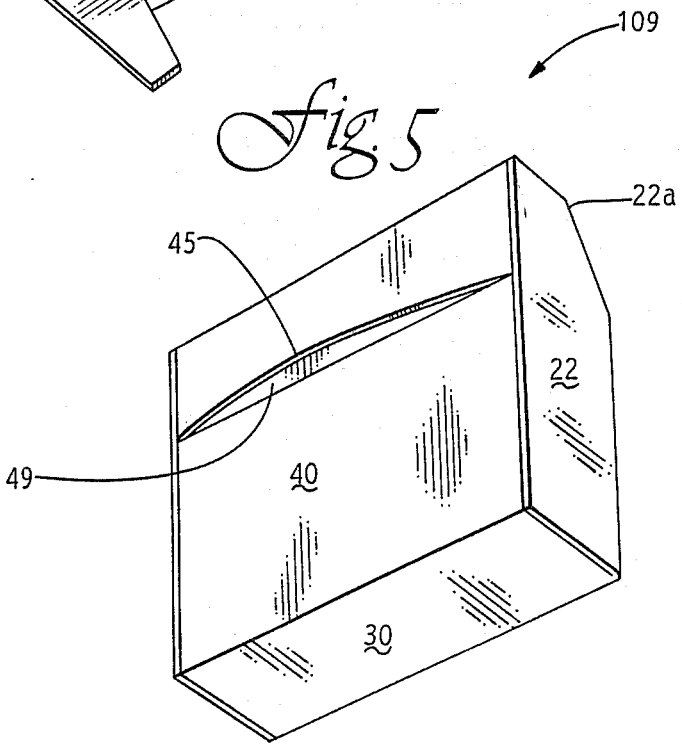
FIG. 5 is a perspective view of the completed base part of the box showing the rear, bottom and right sides thereof.

FIG. 1*a* shows a typical score used to form a fold line in a paperboard blank used in the present invention. The score 120 offsets a portion of the paperboard, creating a bead 122 between two creases 124, 125. An advantage of this type of score is that when the paperboard is folded with the bead 122 compressed on the interior of the fold, there is a small resilient force that works against the direction of folding. That is, the paperboard is urged back to its pre-fold, flat position. This spring action can be used to advantage in some situations. For example, as shown in FIGS. 2, 4 and 5, folding cover panel 48 inward and gluing it at glue area 46 causes bead compression at fold line 14. This causes paperboard material on either side of the fold line 14 to bow outward slightly. At the hinge slit 45 the center of the rear panel 40 bows out more than the edges, which are attached at fold lines 41 and 43. The middle portion of cover flap 48 between the fold line 14 and glue area 46 also bows out slightly. The result is a slide pocket 49 above the hinge slit 45 into which and in which, as will be described later, the hinge panel 75 can slide. The outward bowing of the hinge slit 45 makes the slide pocket 49 open from below to receive the hinge panel 75.

As best seen in FIGS. 2–5, the base blank 9 is assembled to form the base part 109, a box of generally rectangular cross section with an open top. The front panel 20 with the reinforcing panel 25 folded inward at 180 degrees and affixed to the interior of the front panel 20 at glue area 26 forms the front wall of the open-top base part 109. The rear panel 40 with the slide pocket cover panel 48 folded inward at 180 degrees and affixed to the interior of the rear panel 40 at the glue area 46 forms the rear wall of the open-top base. It should be noted that the surface of the rear panel 40 between the hinge slit 45 and the third major fold line 14 is not affixed to the slide pocket cover panel 48, although it lies adjacent thereto. The two side walls of the generally rectangular box formed from the base blank 9 are made by folding the two inner side wall panels 42, 44 and the two base corner reinforcing flaps 32, 34 inward at 90 degrees and superimposing on them the two outer side panels 22, 24, also folded at 90 degrees. The angular cuts **42*a*, 44*a* of the inner side panels 42, 44 complement the shape of the base corner reinforcing flaps 32, 34. The inner and outer side wall panels 42, 44 and 22, 24 and the base corner reinforcing flaps 32, 34** are glued or affixed together by other suitable means.

As best seen in FIGS. 7–10, the cover blank 10 is assembled into the cover part 110 of the two-part carton of the present invention by forming another box of roughly rectangular cross section. In this cover part 110 the lower end of the box is open and the rectangular cross section is slightly larger than for the base part 109. The front wall of the cover part 110 of the carton is formed by front panel 50 with the front reinforcing panel 55 folded inward at 180 degrees and affixed to its interior at the glue area 57. In this configuration, the circular grip cutout 56 becomes an accurate notch for grasping the front wall. The inner and outer side wall panels 72, 74 and 52, 54, respectively, form the side walls of the cover part 110. The inner side wall panels 72, 74, together with the corner reinforcing flaps 62, 64 are folded inward at 90 degrees, with the corner reinforcing flaps 62, 64 fitting into the inner side wall panels 72, 74. This is facilitated by the angular cuts **72*a*, 74*a* that complement the shape of the corner reinforcing panels 62, 64. The inner and outer side wall panels 72, 74 and 52, 54 and the corner reinforcing flaps 62, 64** are glued or affixed together by other suitable means.

Figure 12:
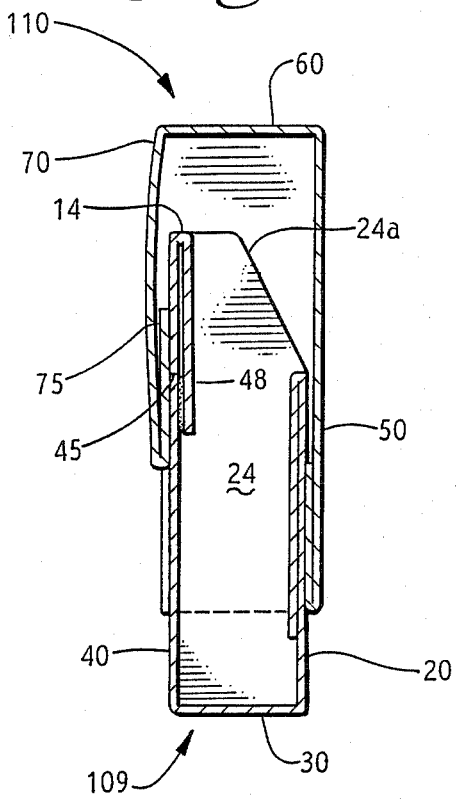
FIG. 12 is a sectional right side elevation taken through the central axis of partially assembled cover and base parts of the carton.
Figure 13:
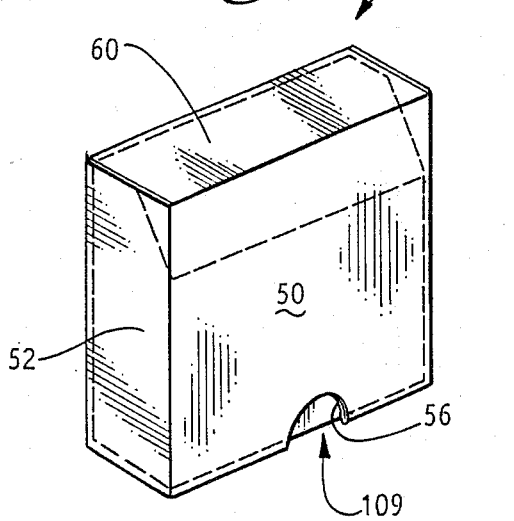
FIG. 13 is a perspective view of a fully assembled carton.
Figure 14:
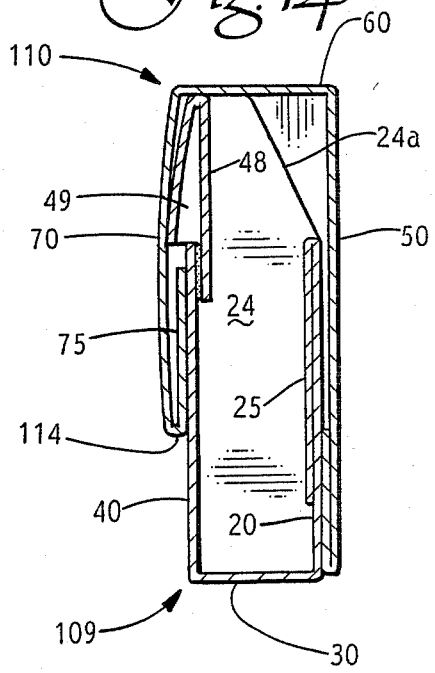
FIG. 14 is a sectional right side elevation taken through the central axis of the fully assembled carton of FIG. 13.
Figure 15:
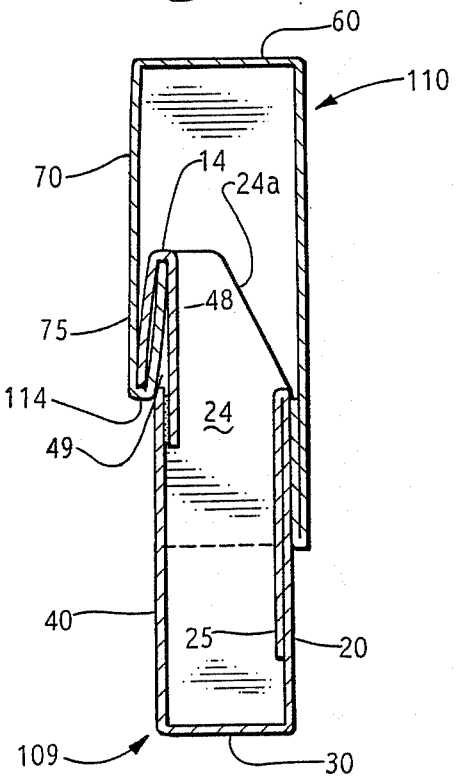
FIG. 15 is a view similar to that of the preceding FIG. 14, with the cover part of the carton raised to its highest position.

To complete assembly, the separate base and cover parts 109, 110 of the carton are joined by folding hinge panel 75 inward at 180 degrees so that it lies adjacent the interior of the rear panel 70 (see FIG. 9) and inserting the open top of the base part 109 into the open lower end of the cover part 110. Due to the resilient bead (as described in connection with FIG. **1*a*) that is thereby compressed at fold line 114, the folded hinge panel 75 is urged away from the rear panel 70. Because of this configuration and the slide pocket 49 discussed earlier, the hinge panel 75 slides past the hinge slit 45 when the cover part 110 is pushed down to fully enclose the base part 109 (FIGS. 12, 13), and, at the same time, the hinge flap 75 springs against the rear panel 40 of the base part 109 to lie directly below the bowed opening of the slide pocket 49 (FIG. 14). As the cover part 110 is again raised, the hinge panel 75 becomes inserted in the slide pocket 49 through the hinge slit 45 of the rear panel 40. The hinge panel 75 then occupies the flat space of the slide pocket 49 between the upper portion of the rear panel 40 and the slide pocket panel 48 (FIG. 15**).

Figure 18:
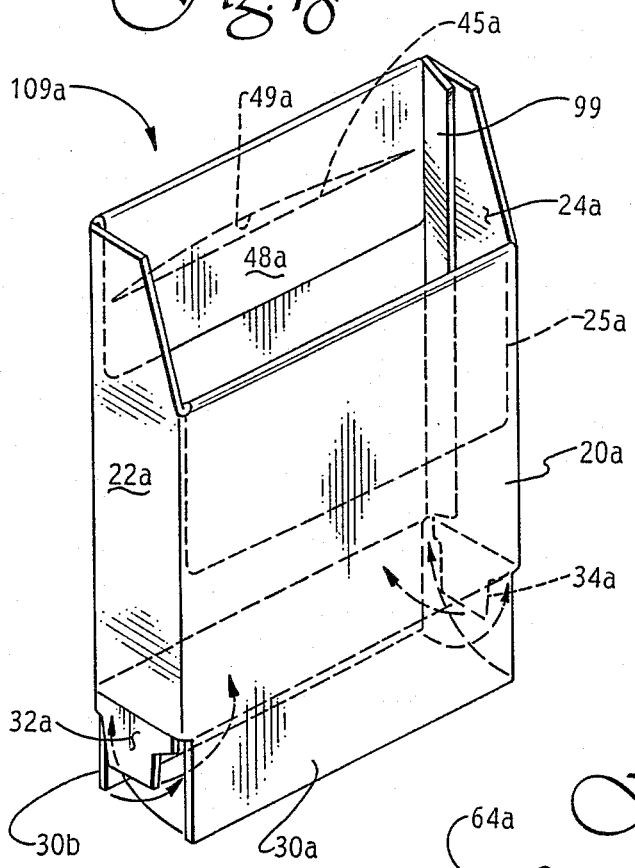
FIG. 18 is a perspective view of the base part of an alternative embodiment of the invention partially assembled.
Figure 19:
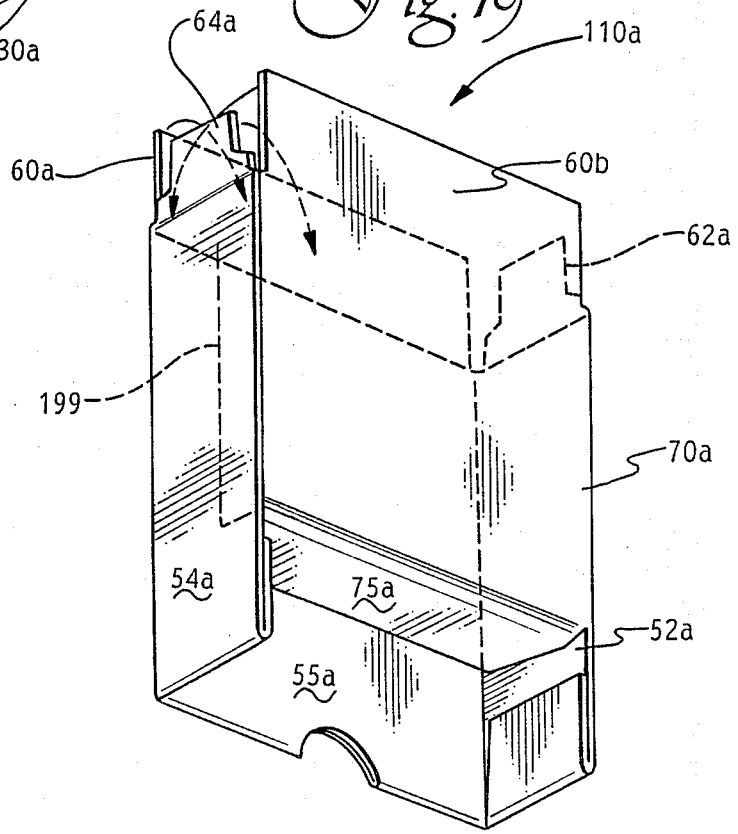
FIG. 19 is a perspective view of the cover part of an alternative embodiment of the invention partially assembled.

An alternative embodiment of the invention is shown in FIGS. 18 and 19. While this invention has the same hinge panel/hinge pocket structure as the previously discussed embodiment, the base part **109*a* (FIG. 18) and the cover part 110*a* (FIG. 19) are made from blanks somewhat different from those in FIGS. 1 and 6. While the blanks of FIGS. 1 and 6 are assembled primarily by a sequence of 180 degree and 90 degree folds at the four parallel fold lines that separate the front, rear and bottom or top panels (11–14 in FIG. 1; 111–114 in FIG. 6), the blanks of FIGS. 18 and 19 are assembled primarily by a sequence of folds at fold lines that are perpendicular to the primary assembly fold lines of the blanks in FIGS. 1 and 6. Also, while each of the right and left sides of the base and cover parts 109, 110 made from the blanks of FIGS. 1 and 6 are double thickness, only the bottom and top walls of the base and cover parts 109*a*, 110*a*** are double thickness over their entire surface.

Figure 3:
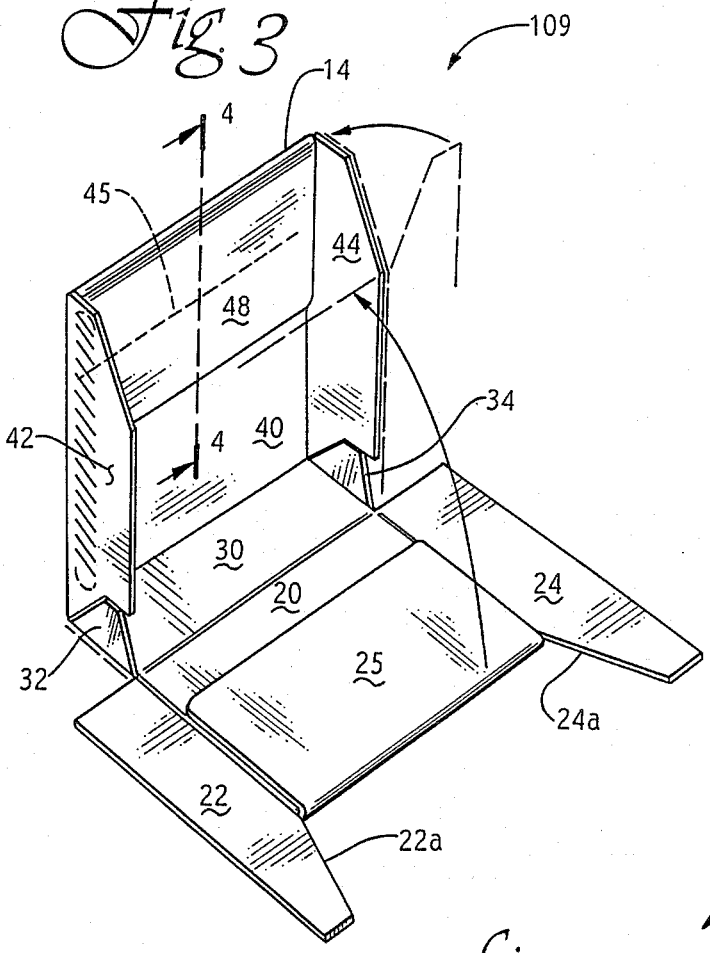
FIG. 3 is a perspective view of the base blank partially glued and folded, showing the completed form in dashed secondary position lines.
Figure 8:
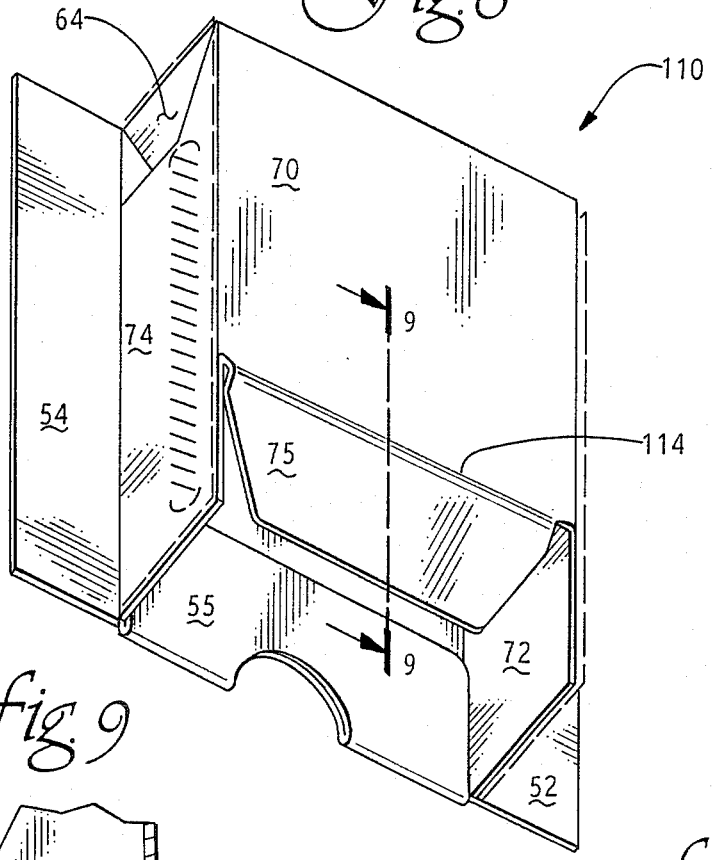
FIG. 8 is a perspective view of the cover blank of FIGS. 6 and 7, partially glued and folded and showing the completed form in dashed secondary lines.
Figure 9:
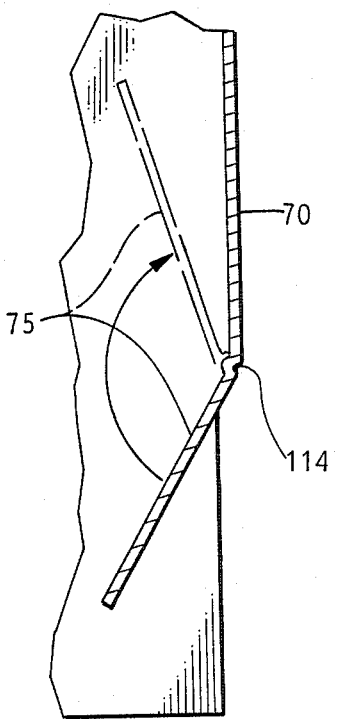
FIG. 9 is an enlarged fragmentary section taken along line 9—9 of FIG. 8 and showing the range of motion of the hinge panel.

To see the close relationship between the embodiment of FIGS. 18 and 19 and the previously-discussed embodiment, comparison can be made between FIG. 18 and FIG. 3, as to the base part, and FIG. 19 and FIG. 8 as to the cover part. To assist comparison, comparable elements in the two embodiments have been given the same numbers, except that the numbers in FIGS. 18 and 19 have the suffix "a". The two exceptions to this numbering scheme for comparable parts are found in the manufacturers glue flap, labeled 99 in FIG. 18 and 199 in FIG. 19, and in the double thicknesses of the bottom wall and top wall, where the two thicknesses are labeled **30*a*, 30*b* and 60*a*, 60*b*, respectively. FIGS. 18 and 19 show the alternative blanks assembled except for these bottom and top walls. Their assembly is indicated by arrows. The corner reinforcing flaps 32*a*, 34*a* and 62*a*, 64*a* are folded in first, followed by the larger flaps 30*a*, 30*b* and 60*a*, 60*b*** that form and seal the bottom and top walls.

Once the alternative base and cover parts **109*a*, 110*a* are assembled separately, they are brought together in exactly the same manner as was described by reference to FIGS. 11–15. That is, the hinge panel 75*a* is bent 180 degrees inward, and the bottom part 109*a* is nested within the top part 110*a*. The hinge panel 75*a* is then properly positioned to slide into and slide in the slide pocket 49*a***.

Operation

Figure 16:
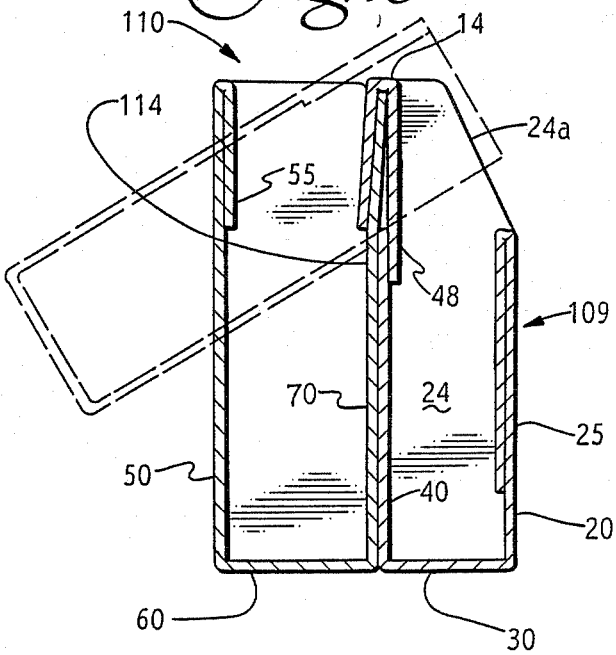
FIG. 16 is a view similar to the preceding FIG. 15 but showing the cover part of the carton rotated counterclockwise to lie adjacent and connected to the base part of the carton by means of the hinge panel and showing an intermediate rotational position in dashed line.

The assembled carton is fully closed when the base part 109 is completely nested inside the cover part 110. To open the carton, the cover part 110 is moved upward until the outer edge of the hinge panel 75 enters the slide pocket 49 and ultimately encounters the fold line 14 between the rear panel 40 and the slide pocket cover panel 48. At this point the cover part 110 of the carton can be tipped backwards, because the angle cuts **22*a*, 24*a* of the side panels 22, 24 are present. The cover part 110 can then be rotated 180 degrees around the sixth major fold line 114 along the inner edge of the hinge panel 75 (FIG. 16). When the cover part 110 of the carton has been rotated 180 degrees, the rear panel 70 of the cover part 110 lies adjacent and parallel to the rear panel 40 of the base part 109. Also, both the bottom panel 30 and the top panel 60 can rest on the same support surface. This provides a stable base for the carton in its open position that has twice the area of the base part 109** of the carton by itself.

The alternative embodiment of the base and cover parts 109*a*, 110*a* shown in FIGS. 18 and 19, closes and opens in exactly the same manner as the previously described embodiment, because its hinge panel/hinge pocket structure is the same. The hinge panel 75*a* slides into the hinge pocket 49*a*. The cover part 110*a* slides upward and rotates relative to the base part 109*a* just as shown in FIG. 16. When fully opened, the alternative embodiment rests on its double-thickness bottom and top walls formed from panels 30*a*, 30*b* and 60*a*, 60*b*, respectively.

In conclusion, when the base and cover blanks 9, 10 of the present invention are assembled into a two-part carton, the two parts 109, 110 slide relative to each other for opening and closing. When the carton is in its open position, the two carton parts 109, 110 remain connected at a hinge panel unless deliberately separated. In addition, the two carton parts 109, 110 form a stable base for an open-topped, two-compartment filing box. The user can easily remove and replace computer diskettes or other contained articles from either compartment. While it is possible to deliberately separate the base and cover parts of the carton (by lifting the base part 109 relative to the cover part 110 when the cover part 110 is inverted as in FIG. 16), in normal use they remain connected at the hinge panel 75. This connection tends to prevent the two parts from being separated and inadvertently associated with the base or cover part of another similar carton. The blanks used are quite simple and can be easily manufactured by die cutting. Only two blanks are needed to form the entire carton.

It will be seen by those skilled in the art that various changes may be made in the preferred embodiment shown above without departing from the scope of the invention. For example, it will be clear that the shape of the side panels and the hinge can be varied somewhat and that the inner and outer side panels could be reversed, as long as these perform the essential functions described above. In addition, it will be clear that the two front reinforcing flaps 25, 55 are not necessary to the invention, although they are believed to provide a benefit. Further, as mentioned previously, although an embodiment has been shown in which the hinge is part of the cover part 110, it could be part of the base part 109 by simple reversal. Additionally, while the present invention is formed from two blanks, each with a number of panels, it will be clear that these panels could be separately formed pieces that are attached to central panels by adhesives or other such means. The invention is therefore not limited to what is shown in the drawings and described in the specification but only as indicated in the appended claims.

What is claimed as new and desired to be secured by Letters Patent is:

1. A two-part sliding carton comprising:

a base part having generally the shape of a box with rectangular cross-sections open at the top and having a bottom panel on which said base part normally rests and a rear panel with a hinge slit therein, said slit being generally parallel to said bottom panel and covered by a cover panel affixed to the interior of the base part below said hinge slit, said cover panel extending from below the hinge slit substantially to the upper edge of said rear panel to define a slide pocket between said hinge slit and said upper edge that opens in the direction of said bottom panel; and a cover part having generally the shape of a box with rectangular cross-sections slightly larger than the comparable cross-sections of the base part, said box being open at the bottom, said cover part having a rear panel with a hinge panel joined to the bottom edge of said rear panel at a hinge fold line, said hinge panel being folded toward the interior of said cover part such that said hinge slit to lie between said rear panel and said cover panel in the slide pocket when the cover part is nested over the base part and is raised relative to the base part for opening the carton and said hinge panel remaining in said slide pocket when the carton is opened by rotating the two parts relative to each other around the hinge fold line until the cover part no longer covers the base part.

2. The carton as recited in claim 1 wherein the cover panel is a panel integrally formed with the rear panel of said base part and is folded inward to lie adjacent to the interior of said rear panel of said base part, said cover panel being joined to said rear panel at a fold line parallel to said bottom panel and being affixed to the interior of said rear panel of said base part below the hinge slit.

3. The carton as recited in claim 2 wherein the fold line at which said cover panel joins said rear panel of said base part is an offset score with the offset bead being compressed when the cover panel is folded inward to lie against the rear panel of the base part.

4. The carton as recited in claim 3 wherein the hinge fold line at which said hinge panel is joined to the bottom edge of the rear panel of said cover part is an offset score with the offset bead being compressed when the hinge panel is folded inward to lie against the rear panel of the cover part.

5. The carton as recited in claim 1 wherein the length of the hinge panel from the hinge fold line to the opposing free edge is substantially equal to the distance between the hinge slit and the upper edge of the rear panel of said base part.

6. The carton as recited in claim 1 wherein the dimension of the rear panel of said cover part between the hinge fold line and the opposing parallel edge of the rear panel is substantially equal to the length of the rear panel of said base part from the hinge slit to the bottom panel of said base part.

7. The carton as recited in claim 1 wherein said base part comprises:

a front panel substantially parallel to the rear panel of said base part, with the height of the front panel above the bottom panel of said base part being less than the corresponding height of the rear panel; and a pair of side walls joining said front and rear panels of said base part, the upper edge of each side wall being cut at a slope so as to rise from the height of the front panel to the height of the rear panel of said base part.

8. A two-piece blank for forming a rectangular box carton comprising:

(a) a first piece for forming a generally rectangular box having an open end comprising:
(i) a generally rectangular front panel;
(ii) a generally rectangular bottom panel connected to an edge of said front panel at a first major fold line;
(iii) a generally rectangular rear panel connected to said bottom panel at a second major fold line parallel to said first major fold line, said rear panel having a hinge slit therein parallel to said second major fold line, said slit extending a substantial distance across the width of said rear panel and lying intermediate said second major fold line and a third major fold line forming an opposing, parallel edge of said rear panel; and
(iv) a pair of side wall panels attached to at least one of said front or rear panels at opposing parallel side fold lines defining side edges of said front and rear panels, said side fold lines being substantially perpendicular tot he respective major fold lines defining the other edges of said panels; and (b) a second piece for forming a generally rectangular box having an open end comprising:
(i) a generally rectangular front panel of said second piece;
(ii) a generally rectangular top panel connected to an edge of said front panel of said second piece at a fourth major fold line;
(iii) a generally rectangular rear panel of said second piece connected to an edge of said top panel at a fifth major fold line opposing and parallel to said fourth major fold line;
(iv) a pair of side wall panels attached to at least one of said front or rear panels of said second piece at opposing parallel side fold lines defining side edges of said front and rear panels of said second piece, said side fold lines being substantially perpendicular to the respective major fold lines defining the other edges of said panels; and
(v) a hinge panel connected to an edge of said rear panel of said second piece at a sixth major fold line parallel to said fifth major fold line.

9. The two-piece blank recited in claim 8 wherein said hinge panel has a width between its edge at the sixth major fold line and the opposing free edge that is less than the distance between the third major fold line and the hinge slit of said first piece and further has a dimension perpendicular to said width that is less than he length of said hinge slit.

10. The two-piece blank recited in claim 8 wherein said first piece further comprises a slide pocket over panel connected to an edge of said rear panel at the third major fold line, said cover panel having a width between its edge at the third major fold line and its opposing parallel edge that exceeds the distance between the third major fold line and the hinge slit.

11. The two-piece blank recited in claim 8 wherein each of the front and rear panels of said first and second pieces has a pair of side wall panels attached thereto at said opposing parallel side fold lines.

12. The two-piece blank recited in claim 8 wherein the bottom panel of said first piece has a pair of corner reinforcing panels attached thereto at opposing parallel side fold lines defining side edges of said bottom panel, said side fold lines being substantially perpendicular to the major fold lines defining the other edges of said bottom panel.

13. The two-piece blank recited in claim 8 wherein the front panel of said first piece has a reinforcing panel connected to said front panel at an auxiliary fold line opposite and parallel to said first major fold line.

14. The two-piece blank recited in claim 8 wherein the front panel of said second piece has a reinforcing panel connected to said front panel at an auxiliary fold line opposite and parallel to said fourth major fold line.

15. A two-piece blank for forming a rectangular box carton comprising:

(a) a first piece for forming a generally rectangular box having an open end comprising:
(i) a generally rectangular first side wall panel;
(ii) a generally rectangular front panel joined to said first side wall panel at a first fold line;
(iii) a generally rectangular second side wall joined to said front panel at a second fold line parallel to said first fold line;
(iv) a generally rectangular rear panel joined to said second side wall at a third fold line parallel to said fold line, said rear panel having a hinge slit therein perpendicular to said third fold line, said slit extending a substantial distance across the width of said rear panel and lying intermediate the parallel edges of said rear panel that are perpendicular to said third fold line; and
(v) an end panel joined to at least one of said front and rear panels at an end panel fold line perpendicular to said first fold line; and (b) a second piece for forming a generally rectangular box having an open end comprising:
(i) a generally rectangular first side wall of said second piece;
(ii) a generally rectangular front panel of said second piece joined to said first side wall panel of said second piece at a fourth fold line;
(iii) a generally rectangular second side wall of said second piece joined to said front panel of said second piece at a fifth fold line;
(iv) a generally rectangular rear panel of said second piece joined to said second side wall of said second piece at a sixth fold line;
(v) a hinge panel joined to said rear panel of said second piece at a seventh fold line perpendicular to said sixth fold line; and
(vi) an end panel joined to at least one of said front and rear panels of said second piece at end panel fold line that is parallel to said seventh fold line.

16. The two-piece blank as recited in claim 15 wherein said hinge panel has a width between its edge at the seventh fold line and the opposing free edge that is less than the distance between the hinge slit and the nearest edge of the rear panel of said first piece that is parallel to the hinge slit.

17. The two-piece blank as recited in claim 15 wherein said first piece further comprises a slide pocket cover panel joined to an edge of said rear panel at a cover panel fold line that is parallel to the hinge slit, said slide pocket cover panel having a width measured perpendicular to said cover panel fold line that exceeds the distance between said cover panel fold line and the hinge slit.

18. The two-piece blank as recited in claim 15 wherein the first-piece has a glue flap joined to the free edge of the rear panel of said first piece that is parallel to said third fold line and the second piece has a glue flap joined to the free edge of the rear panel of said second piece that is parallel to the sixth fold line.

19. The two-piece blank as recited in claim 15 wherein each of the front and rear panels of said first piece has an end panel joined thereto at a fold line perpendicular to said first fold line and each of the front and rear panels of said second piece has an end panel joined thereto at a fold line perpendicular to said fourth fold line.

20. The two piece blank as recited in claim 19 wherein each of the front panels of said first and second pieces has a reinforcing panel joined thereto at a fold line parallel and opposite to said fold line at which the end panel of each said front panel is joined to said front panel.

* * * * *

UNITED STATES PATENT AND TRADEMARK OFFICE

CERTIFICATE OF CORRECTION

PATENT NO. : 4,784,315

DATED : November 15, 1988

INVENTOR(S) : Daniel P. Dutcher

It is certified that error appears in the above-identified patent and that said Letters Patent is hereby corrected as shown below:

In the Description of the Preferred Embodiment, Column 5, line 48, delete the word "accurate" and substitute therefor the word --arcuate--.

In claim 1, column 8, line 18, after the word "hinge" insert the words --panel is slidably inserted through the hinge--.

In claim 8, column 9, line 22, delete the words "tot he" and substitute therefor the words --to the--.

In claim 10, column 9, line 53, delete the word "over" and substitute therefor the word --cover--.

Signed and Sealed this

Twenty-first Day of November, 1989

*Attest:*

JEFFREY M. SAMUELS

*Attesting Officer* *Acting Commissioner of Patents and Trademarks*